United States Patent [19]

Minegishi et al.

[11] 3,992,304

[45] Nov. 16, 1976

[54] SOFTENING AGENT FOR A WOVEN FABRIC

[75] Inventors: Yutaka Minegishi, Saitama; Haruhiko Arai, Narashino, both of Japan

[73] Assignee: Kao Soap Co., Ltd., Tokyo, Japan

[22] Filed: Sept. 25, 1975

[21] Appl. No.: 616,620

[30] Foreign Application Priority Data

Feb. 10, 1975 Japan ..... 50-17127

[52] U.S. Cl. ..... 252/8.8; 8/115.5; 260/18 N

[51] Int. Cl.[2] ..... C11C 1/00; C11D 1/62; D06M 13/46

[58] Field of Search ..... 252/8.8

[56] References Cited

UNITED STATES PATENTS

| | | | |
|---|---|---|---|
| 3,347,803 | 10/1967 | Frotscher et al. | 260/2 |
| 3,793,352 | 2/1974 | Hochreuter | 260/404.5 |
| 3,872,138 | 3/1975 | Ogata | 260/404 |

*Primary Examiner*—John Kight, III

*Attorney, Agent, or Firm*—Woodhams, Blanchard and Flynn

[57] ABSTRACT

A liquid softening agent for a woven fabric contains 1. a cationic polyamide compound (A) which is prepared by the steps of reacting 1 mol of diethylene triamine or dipropylene triamine with about 2 mols of a long chain fatty acid to thereby form a condensate of an acid value of not greater than 10; adding about 1 to 2 mols of epichlorohydrin to the condensate; subjecting the resulting adduct to the ring-opening polymerization in the presence of an alkali agent; and thereafter neutralizing the polymer thus formed with an acid;

and 2. a quaternary ammonium salt (B) expressed by the following general formula

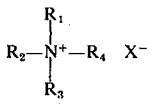

wherein each of $R_1$ and $R_2$ is a long chain alkyl group or a long chain $\beta$-hydroxyalkyl group; $R_3$ and $R_4$ are an alkyl group or hydroxyalkyl group, a benzyl group or $-(C_2H_4O)_nH$; and X is a halogen or a monoalkyl sulfuric acid group.

4 Claims, No Drawings

SOFTENING AGENT FOR A WOVEN FABRIC

BACKGROUND OF INVENTION

1. Field of Invention

This invention relates to a liquid softening agent for a woven fabric which has an excellent flowability as well as stability, and can impart softness to clothes made of a variety of hydrophilic and hydrophobic materials.

2. Description of Prior Art

Almost all softening agents for household use that are put on the market at present are of the composition consisting predominantly of a quaternary ammonium salt which has two long-chain alkyl groups in 1 molecule thereof. To use the composition for household use easily, most of them are liquefied. Though the quaternary ammonium salt per se is hydrophilic, it has a small solubility in water. If the quaternary ammonium salt, as it is, is kept as an aqueous solution of a high concentration, it changes easily to a gel-like state whereby the preparation of a stable composition of a low viscosity becomes almost impossible.

In order to solve the problems, attempts have been made to obtain a more stable composition having a low viscosity by adding to the quaternary ammonium salt various additives such as a solvent, an inorganic salt, a nonionic surface active agent, a cationic activator such as mono-long-chain alkyl quaternary ammonium salts, and the like.

These methods, however, fail to sufficiently satisfy the required dispersion stability as well as recovery from freezing at various temperatures without causing any disadvantage on the softness.

Since the above-mentioned quaternary ammonium salt is used as a principal component of softening agents for household use available nowadays, further, the agents can provide only inferior effects for synthetic fibers such as acrylic-type, polyamide-type, etc., although they exhibit a remarkable effect on cottons. On the contrary, softening agents for an industrial use, but not for household use, hardly exhibit any effect on cottons.

SUMMARY OF INVENTION

It is therefore a primary object of the present invention to eliminate the above-mentioned defects of conventional liquid softening agents, and provide a liquid softening agent of a low viscosity which has remarkably improved dispersion stability and recovery from freezing, and which imparts an excellent softening effect on various fiber materials.

The abovementioned object of the present invention can be accomplished by a liquid softening agent for a woven fabric of the invention, said agent containing 1. a cationic polyamide compound (A) which is prepared by the steps of reacting 1 mol of diethylene triamine or dipropylene triamine with about 2 mols of a fatty acid of 12 to 24 carbon atoms to thereby form a condensate of an acid value of not greater than 10; adding about 1 to 2 mols of epichlorohydrin to the condensate; subjecting the resulting adduct to the ring-opening polymerization in the presence of an alkali agent; and thereafter neutralizing the thus formed polymer with an acid to form said cationic polyamide compound;

and 2. a quaternary ammonium salt (B) expressed by the following general formula

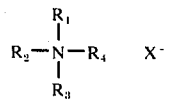

wherein each of $R_1$ and $R_2$ is an alkyl group of 12 to 20 carbon atoms or a $\beta$-hydroxyalkyl group of 14 to 22 carbon atoms;

each of $R_3$ and $R_4$ is an alkyl group or hydroxyalkyl group of 1 to 3 carbon atoms, a benzyl group or $-(C_2H_4O)_nH$ ($n = 1$, 2 or 3); and X is a halogen or a monoalkyl sulfuric acid group having an alkyl group of 1 to 3 carbon atoms;

whereby the weight ratio of the polyamide compound (A) to the quaternary ammonium salt (B) is from about 0.05 to about 5, and the total of the polyamide (A) and the quaternary ammonium salt (B) is from about 3 to 15% by weight.

The cationic polyamide compound constituting the softening agent for a woven fabric in accordance with the present invention is a mixture of various compounds which are prepared by the following method;

1 mol of diethylene triamine or dipropylene triamine is reacted with about 2 mols of a fatty acid of 12 to 24 carbon atoms at a temperature of 100° to 160° C. till the acid value of the resulting condensation products becomes not greater than 10. Next, about 1 to 2 mols of epichlorohydrin is added dropwise to the resulting condensate which is kept at 100° – 160° C. whereupon an adduct is formed almost instantaneously. After cooling the adduct down to about 60° – 100° C., 0.05 – 1 mol of an alkali agent is added to carry out the ring-opening polymerization of the adduct. Finally, the polymerization product thus obtained is neutralized with an acid to thereby yield the contemplated product.

Examples of fatty acids of 12 to 24 carbon atoms that are used in the above-mentioned reaction include lauric acid, myristic acid, palmitic acid, stearic acid, arachidic acid, behenic acid, lignoceric acid, hydrogenated tallow acid, hydrogenated rapeseed oil acid and hydrogenated palm oil acid.

There is no specific limitation to the type of an alkali agent to be made present during the ring-opening polymerization of the adduct of epichlorohidrin, but preferred is an aqueous solution of caustic soda or caustic potash.

Examples of acids that are used as a neutralizing agent finally in the reaction are mineral acids such as hydrochloric acid, nitric acid, etc., and monobasic acids of 2 to 3 carbon atoms such as acetic acid, propionic acid, glycolic acid and the like.

Preparation method of the cationic polyamide compound to be used in the present invention will be understood in detail from the later-appearing Referential Examples.

In view of the condition for household use which is 20 cc/30 liter at present, the total of the compounding amounts of the cationic polyamide compound (A) and the quaternary ammonium salt (B) as the components for the woven fabric softening agent of the present invention is preferably 3% by weight or more. However, the amount exceeding 15% by weight is not desirable from the viewpoint of the viscosity, stability during storage and economy of the liquid composition. The compounding proportion by weight of the compound (A) to the compound (B) is in the range of from about 0.05 to 5. If the ratio is less than 0.05, the softening effect for the synthetic fibers becomes unsufficient, and the softening effect on cottons lowers, on the contrary, when the ratio is more than 5.

The woven fabric softening agent composition in accordance with the present invention is an aqueous solution containing the cationic polyamide compound (A) and the quaternary ammonium salt (B), and the viscosity can further-more be controlled by the addition thereto of a polyethylene glycol-type nonionic surface active agent, an inorganic salt such as table salt or ammonium chloride, a solvent such as propylene glycol, and isopropyl alcohol, urea and the like. In order to provide finished products with an appreciable outlook, a pigment or dyestuff may further be added thereto, and a fluorescent whiting agent may, if desired, be added likewise to increase whiteness of the products. In order to impart pleasing odor during usage or after finishing, fragrants may also be incorporated.

The method for the preparation of the cationic polyamide compound to be used in the invention will now be exemplified with reference to the following Referential Examples.

REFERENTIAL EXAMPLE 1

52 g of diethylene triamine is added to 280 g of stearic acid, and heated at 120 – 140° C. for 4 hours. In this instance, about 15 g of water is distilled. Next, the mixture is heated at 140° – 150° C. for 6 hours, and yields thereby a condensate which has an acid value of 5.9. 69 g of epichlorohydrin is added dropwise at that temperature. After cooling the mixture down to 80° C., 165 g of isopropyl alcohol and 13 g of a 30% aqueous solution of caustic soda are added, and reacted for 6 hours.

Thereafter the reaction solution is neutralized by the addition thereto of 65 g of a 70% aqueous solution of hydroxyacetic acid. The resulting reaction product is a white solid matter that has a melting point of 42° – 46° C., an acid value of 70.0 and a total amine value of 77.0.

REFERENTIAL EXAMPLE 2

The reaction is carried out in the same way as in Referential Example 1 except that 350 g of behenic acid is used as the starting material in place of stearic acid.

The condensation product between behenic acid and diethylene triamine has an acid value of 6.0, and the final product thus formed has a melting point of 58° – 62° C., an acid value of 61.2 and a total amine value of 66.7.

Incidentally, the molar ratio between each component fed is as follows;

diethylene triamine:fatty acid:epichlorohidrin caustic soda:hydroxyacetic acid = 1:2:1.5:0.2:1.2

REFERENTIAL EXAMPLES 3 – 6

The reactions are carried out in the same way as in Referential Example 1 except that the starting materials as well as the molar ratio thereof are changed variously as indicated in Table 1 together with the results.

Table 1

| Ref. Example | Amine | Fatty acid | Epihalohydrin | Alkali | Acid |
|---|---|---|---|---|---|
| 3 | dipropylene triamine | lauric acid | epichlorohydrin | caustic potash | propionic acid |
| 4 | " | hydrogenated tallow acid | " | " | glycolic acid |
| 5 | diethylene triamine | hydrogenated rapeseed oil acid | " | caustic soda | hydrochloric acid |
| 6 | " | hydrogenated palm oil acid | " | " | nitric acid |

| Mol ratio | Acid value of condensate of amine and fatty acid | Cationic polyamide compound M.P. (° C) | acid value | total amine value |
|---|---|---|---|---|
| 1/2/1.5/0.2/1.2 | 5.6 | 20 – 25 | 84.7 | 104.9 |
| 1/2/1.5/0.2/1.2 | 4.2 | 45 – 48 | 70.0 | 77.0 |
| 1/2/1.5/0.2/1.5 | 3.6 | 48 – 56 | 68.3 | 71.5 |
| 1/2/1.5/0.2/1.5 | 4.4 | 34 – 38 | 76.2 | 83.4 |

The present invention will be made more apparent with reference to the following Examples.

EXAMPLE 1

| Compound Composition | % by weight |
|---|---|
| Cationic polyamide compound (A) of Referential Example 2 | 0 – 10 |
| distearyl dimethyl ammonium chloride (B) | 0 – 10 |
| Water | balance |

The relations between the compounding amount as well as the compounding proportion of each component and the viscosity of the solution, dispersion stability and recovery from freezing, and the softness imparted to various fibers, are determined on the basis of the abovementioned compounding composition. The results are illustrated in Tables 2-1 and 2-2, respectively.

The viscosity is measured at 25° C. by use of a BM-type viscometer. The recovery from freezing is measured by freezing the sample at −15° C., then leaving the frozen sample at 30° C. to allow it dissolve, and repeating these procedures five times. The dispersion stability is determined by leaving the sample in a thermostat at 50° C. for 4 weeks to observe its state of separation. Finally, the softness is indicated by means of a pair-comparison with the result of the treatment using the quaternary ammonium salt alone as control for the pair-comparison.

The recovery from freezing and dispersion stability are observed only for the compositions having a viscosity of not greater than 3,000 cps.

The softening treatment is effected by the method which involves the steps of washing clothes made of various fibrous materials (commercial products) with the detergent "New Beads" (a product of Kao Soap Co., Ltd.; a registered trademark) three times, hardening them sufficiently, and then treating them with a 0.067% aqueous solution (city water) at 25° C. and a bath rate of 1/30 for 5 minutes.

Table 2-1

| | Ratio (A/B) | Viscosity (cps) | | | | | Recovery from freezing | | | | | Dispersion stability | | | | |
|---|---|---|---|---|---|---|---|---|---|---|---|---|---|---|---|---|
| A + B | | 0 | 0.1 | 0.5 | 1 | 5 | 0 | 0.1 | 0.5 | 1 | 5 | 0 | 0.1 | 0.5 | 1 | 5 |
| 3 wt. % | | gel | 66 | 38 | 18 | 12 | — | O | ◎ | ◎ | ◎ | — | ◎ | O | O | O |
| 5 wt. % | | gel | 327 | 73 | 45 | 31 | — | O | ◎ | ◎ | ◎ | — | ◎ | ◎ | ◎ | O |
| 7 wt. % | | gel | 631 | 105 | 69 | 53 | — | Δ | ◎ | ◎ | ◎ | — | ◎ | ◎ | ◎ | O |
| 10 wt. % | | gel | 1982 | 396 | 201 | 122 | — | Δ | Δ | Δ | ◎ | — | ◎ | ◎ | ◎ | ◎ |
| 15 wt. % | | gel | gel | 1751 | 489 | 208 | — | — | X | X | O | — | — | ◎ | ◎ | ◎ |
| *Comparative Examples | X | | 100 | | | | separated and gelled | | | | | | | O | | |
| | Y | | 155 | | | | gelled | | | | | | | O | | |
| | Z | | gel | | | | — | | | | | | | — | | |

Evaluation: ◎ : Very good O : Good Δ : Bad X : Very bad

*Composition of Comparative Examples:

| | | |
|---|---|---|
| X | distearyl dimethyl ammonium chloride | 6.0 wt. % |
| | lauryl trimethyl ammonium chloride | 1.0 wt. % |
| | water | balance |
| Y | distearyl dimethyl ammonium chloride | 6.0 wt. % |
| | polyoxyethylene(25)lauryl ether | 1.0 wt. % |
| | water | balance |
| Z | distearyl dimethyl ammonium chloride | 6.0 wt. % |
| | ethylene glycol | 5.0 wt. % |
| | water | balance |

Table 2-2

| | Clothes for Treatment A/B | Softness | | | | | | | | | | | | | | |
|---|---|---|---|---|---|---|---|---|---|---|---|---|---|---|---|---|
| | | Cotton towel | | | | | Nylon jersey | | | | | Acrylic jersey | | | | |
| A + B | | 0 | 0.1 | 0.5 | 1 | 5 | 0 | 0.1 | 0.5 | 1 | 5 | 0 | 0.1 | 0.5 | 1 | 5 |
| 3 wt. % | | | 0 | +0.5 | 0 | −1.5 | | 0 | +0.5 | +0.5 | +0.5 | | 0 | +0.5 | +1 | +1 |
| 5 wt. % | | | +0.5 | +1 | +0.5 | −1 | | +0.5 | +1 | +1.0 | +1 | | +0.5 | +2 | +2 | +2 |
| 7 wt. % | | Control | +0.5 | +1 | +1 | −1 | Control | +0.5 | +1.5 | +1.5 | +1.5 | Control | +0.5 | +2 | +2 | +2 |
| 10 wt. % | | | 0 | +0.5 | +0.5 | 0 | | 0 | +0.5 | +1.0 | +1 | | +0.5 | +1 | +1 | +1 |
| 15 wt. % | | | 0 | +0.5 | +0.5 | 0 | | 0 | 0 | +0.5 | +0.5 | | 0 | +0.5 | +1 | +1 |

Evaluation: +2 : Soft
+1 : Considerably soft
0 : Same as control
−1 : Considerably hard
−2 : Hard As can be seen clearly from Table 2–1, distearyl dimethyl ammonium chloride alone causes gelling at the concentration of 3% by weight even at room temperature. Likewise as exemplified in Comparative Examples, the softening agent consisting of distearyl dimethyl ammonium chloride, a nonionic surface active agent and a monoalkyl quaternary ammonium salt has relatively good dispersion stability, but it also causes gelling as a result of repeated procedures of freezing and dissolving. Also, a low viscosity composition cannot be obtained only by the use of a solvent.

On the other hand, when the cationic polyamide compound is mixed in an amount exceeding a predetermined weight proportion to the distearyl dimethyl ammonium chloride, the viscosity decreases remarkably whereby there can be obtained a softening composition which has excellent recovery from freezing as well as dispersion stability.

As is also clear from Table 2—2, when the cationic polyamide is compounded to distearyl dimethyl ammonium chloride in a weight ration of more than 0.1, the composition provides the nylon and acrylic fibers with remarkable softness, and at the same time, exhibits synergistic effects for the cotton.

EXAMPLE 2

| | |
|---|---|
| Cationic polyamide compound of Referential Example 1 | 2 wt. % |
| Distearyl dimethyl ammonium chloride | 4 wt. % |
| Polyoxyethylene(100)oleyl ether | 0.02 wt. % |
| Perfume & Pigment | small amount |
| Water | balance |

EXAMPLE 3

| | |
|---|---|
| Cationic polyamide compound of Referential Example 2 | 2 wt. % |
| Bis(β-hydroxystearyl)diethyl ammonium chloride | 5 wt. % |
| Polyoxyethylene(60)sorbitol hexaoleate | 1 wt. % |
| Urea | 2 |
| Fluorescent dye, pigment & perfume | small amount |

-continued

| | |
|---|---|
| Water | balance |

EXAMPLE 4

| | |
|---|---|
| Cationic polyamide compound of Referential Example 3 | 7 wt. % |
| Dilauryl dipropyl ammonium bromide | 2 wt. % |
| Propylene glycol | 5 wt. % |
| Ammonium chloride | 0.01 wt. % |
| Pigment & Perfume | small amount |
| Water | balance |

EXAMPLE 5

| | |
|---|---|
| Cationic polyamide compound of Referential Example 4 | 1 wt. % |
| Dipalmityl methyl ethylammonium ethyl sulfate | 9 wt. % |
| Isoproyl alcohol | 2 wt. % |
| Sodium chloride | 0.03 wt. % |
| Pigment & Perfume | small amount |
| Water | balance |

EXAMPLE 6

| | |
|---|---|
| Cationic polyamide compound of Referential Example 5 | 1 wt. % |
| Diarakinyl bis(hydroxyethyl)-ammonium chloride | 2 wt. % |
| Perfume | small amount |
| Water | balance |

EXAMPLE 7

| | |
|---|---|
| Cationic polyamide compound of Referential Example 6 | 3 wt. % |
| di-hydrogenated tallow alkyl dimethyl ammonium chloride | 3 wt. % |
| Polyoxyethylene(100)lauryl ether | 0.5 wt. % |
| Ammonium chloride | 0.01 wt. % |
| Pigment, perfume & fluorescent dyestuff | small amount |
| Water | balance |

Viscosity, stability and softness of each composition in the abovementioned Examples 2 through 7 is compared with the corresponding case where the cationic polyamide compound of each compositioned is replaced by the quaternary ammonium salt used therein, in the same way as in Example 1.

The results are shown in Table 3.

Table 3

| | Example | Viscosity at one month after compounding (cps) | Recovery from freezing: Viscosity (cps) | Recovery from freezing: State | Dispersion stability: Viscosity (cps) | Dispersion stability: State | Softness: Cotton Towel | Softness: Nylon Jersey | Softness: Acrylic Jersey |
|---|---|---|---|---|---|---|---|---|---|
| | 2 | 45 | 53 | ◎ | 41 | ◎ | + | + | ++ |
| | 3 | 69 | 78 | ◎ | 72 | ◎ | + | ++ | ++ |
| | 4 | 21 | 38 | ◎ | 19 | O | ± | + | + |
| | 5 | 120 | 157 | O | 95 | ◎ | ± | ± | + |
| | 6 | 52 | 81 | O | 58 | ◎ | + | + | + |
| | 7 | 41 | 44 | O | 37 | ◎ | + | + | ++ |
| Control | 2 | 52 | 650 | Δ | — | X | Control | Control | Control |
| | 3 | gelled | — | — | — | — | | | |
| | 4 | 1030 | — | gelled | — | X | | | |
| | 5 | 870 | — | gelled | — | X | | | |
| | 6 | gelled | — | — | — | — | | | |
| | 7 | 111 | — | gelled | — | X | | | |

Evaluation: ◎ : Very good O : Good Δ : Bad X : Very bad
++ : Softer than control + : Considerably softer than control
± : Soft as control The Embodiments of the invention in which an exclusive property or privilege is claimed are defined as follows:

1. A liquid softening agent for a woven fabric essentially consisting of 1. a cationic polyamide compound (A) which is prepared by the steps of reacting 1 mol of diethylene triamine or dipropylene triamine with about 2 mols of a fatty acid of 12 to 24 carbon atoms to thereby form a condensate of an acid value of not greater than 10; adding about 1 to 2 mols of epichlorohydrin to the condensate; subjecting the resulting adduct to the ring-opening polymerization in the presence of an alkali agent; and thereafter neutralizing the polymer thus formed with an acid;

and 2. a quaternary ammonium salt (B) expressed by the following general formula

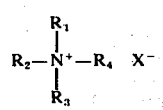

wherein each of $R_1$ and $R_2$ is an alkyl group of 12 to 20 carbon atoms or a $\beta$-hydroxyalkyl group of 14 to 22 carbon atoms; each of $R_3$ and $R_4$ is an alkyl group or hydroxyalkyl group of 1 to 3 carbon atoms, a benzyl group or $-(C_2H_4O)_nH$ ($n = 1, 2,$ or 3); and X is a halogen or a monoalkyl sulfuric acid group having an alkyl group of 1 to 3 carbon atoms;

whereby the weight ratio of said (A) to (B) is from about 0.05 to about 5, and the total of said (A) and (B) is about 3 to 15% by weight.

2. A liquid softening agent as claimed in claim 1, in which said fatty acid is selected from the group consisting of lauric acid, myristic acid, palmitic acid, stearic acid, arachidic acid, behenic acid, lignoceric acid, hydrogenated tallow acid, hydrogenated rapeseed oil acid and hydrogenated palm oil acid.

3. A liquid softening agent as claimed in claim 1, in which the polymerization step is effected in the presence of an aqueous solution of caustic soda or caustic potash.

4. A liquid softening agent as claimed in claim 1, in which said neutralization is effected with a mineral acid selected from the group consisting of hydrochloric acid, and nitric acid or a monobasic acid having 2 to 3 carbon atoms selected from the group consisting of acetic acid, propionic acid and glycolic acid.

* * * * *